United States Patent [19]

Vos

[11] 4,155,671

[45] May 22, 1979

[54] MARINE STRUCTURES

[75] Inventor: Charles J. Vos, Pijnacker, Netherlands

[73] Assignee: Hollandsche Beton Maatschappij B.V., Rijswijk, Netherlands

[21] Appl. No.: 780,675

[22] Filed: Mar. 23, 1977

[30] Foreign Application Priority Data

Mar. 25, 1976 [GB] United Kingdom ..... 12107/76

[51] Int. Cl.[2] ..... E02B 17/02

[52] U.S. Cl. ..... 405/203; 405/210

[58] Field of Search ..... 61/86, 87, 88, 96, 101

[56] References Cited

U.S. PATENT DOCUMENTS

| | | | |
|---|---|---|---|
| 2,877,628 | 3/1959 | Maunsel | 61/43 |
| 3,091,089 | 5/1963 | Gellerstad | 61/96 |
| 3,412,564 | 11/1968 | McClinock | 61/88 |
| 3,698,198 | 10/1972 | Phelps | 61/88 |
| 3,793,842 | 2/1974 | Lacroix | 61/101 |
| 3,896,628 | 7/1975 | Hansen | 61/96 X |
| 3,952,524 | 4/1976 | Rand et al. | 61/43 |

FOREIGN PATENT DOCUMENTS

| | | | |
|---|---|---|---|
| 1430084 | 3/1976 | United Kingdom | 61/88 |

*Primary Examiner*—Mervin Stein
*Assistant Examiner*—Alex Grosz
*Attorney, Agent, or Firm*—Buell, Blenko & Ziesenheim

[57] ABSTRACT

The base of an offshore gravity platform consists of at least two separately formed caissons, preferably of concrete, which are mounted one on top of the other or another. The roof of the lower of adjacent caissons and/or the bottom of the adjacent upper caisson is or are so shaped as to form between the caissons a space which is rendered substantially fluid-tight and wherein, when the platform is floating on the sea and when the platform is standing on the sea bed, fluid pressure in the space between the caissons is such that the two caissons are urged tightly together by hydrostatic pressure. Adjacent caissons may also be mechanically secured together.

21 Claims, 18 Drawing Figures

FIG. 8a.
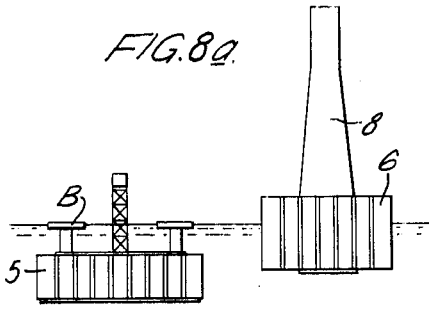
FIG. 8b.
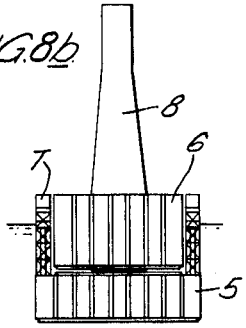
FIG. 8c.
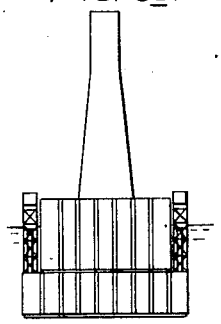
FIG. 8d.
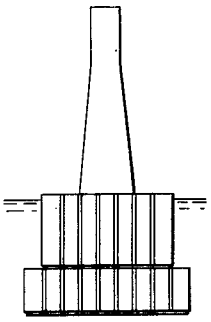
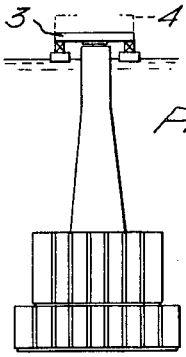
FIG. 8e.
FIG. 8f.
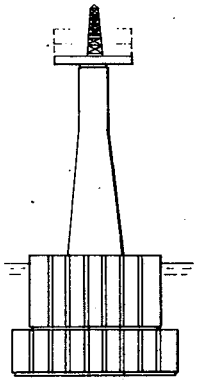
FIG. 8g.
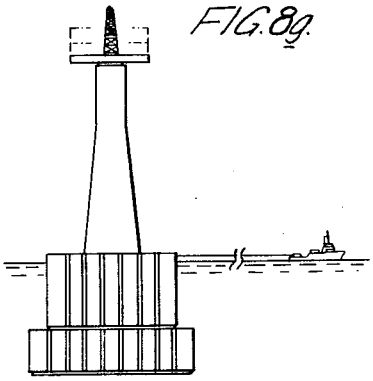
FIG. 8h.
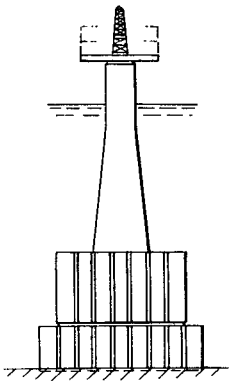

MARINE STRUCTURES

This invention relates to marine structures and is particularly concerned with marine structures of the kind including a hollow base and, upstanding from the base, an upper structure slimmer than the base, which marine structure can form a floating body for movement from one place to another and which, when required, can be sunk to stand on the bed of the sea or other body of water (hereinafter referred to as the sea) with the upper structure protruding above the surface of the sea. Marine structures of this kind will hereinafter, for convenience, be referred to as "offshore gravity platforms of the kind described".

It is an object of the present invention to provide an improved offshore gravity platform of the kind described. It is a further object of the invention to provide an improved method of constructing such an offshore gravity platform.

In the improved offshore gravity platform according to the present invention, the base consists of at least two separately formed caissons which are mounted one on top of the other or another, at least one of the roof of the lower of adjacent caissons and the bottom of the adjacent upper caisson being so shaped as to form between the caissons a space which is rendered substantially fluid-tight and in which fluid pressure is such that said adjacent caissons are urged tightly together by hydrostatic pressure.

The term "caisson" as used herein means a closed hollow body which will float on the sea and which can be submerged by means of ballast.

Any suitable means of effecting a fluid-tight seal between two adjacent caissons may be employed, one or more than one sealing ring of rubber or other elastomeric material being preferred. A rubber ring that is especially suitable is a ring having a Vredestein Gina profile, which rings have been used for obtaining a substantially fluid-tight seal between prefabricated segments of a tunnel being installed underwater.

Where movement of one caisson relative to the other or others is to be substantially prohibited, preferably adjacent caissons constituting the base of the platform are mechanically secured together, for example by tensile connections and/or shear ties.

In a preferred method of mechanically securing together adjacent caissons by shear ties, the roof of the lower or a lower caisson and/or the bottom of the adjacent upper caisson has a continuous or discontinuous groove which surrounds the space formed between the two ciassons and the bottom of the upper caisson and/or the roof of said lower caisson has a continuous or discontinuous skirt extending therefrom of a shape and size such that the skirt engages in the groove and is secured therein. Preferably, the skirt is secured in the groove by means of dowels, each dowel engaging in aligned holes in the part of the roof of said lower caisson (or the bottom of the upper caisson) surrounding the space between the two caissons and in the skirt.

In a preferred method of mechanically securing together adjacent caissons by tensile connections, stressing members protruding from the bottom of the upper of adjacent caissons and from the roof of the lower caisson are coupled together and are so stressed that the two caissons are mechanically secured together under tension. Stressing members protruding from the bottom of the upper caisson preferably are at spaced positions around a continuous channel formed between two continuous walls which extend downwardly from the bottom of the upper caisson into the space formed between the two caissons and are spaced from the boundary wall of said space.

The substantially fluid-tight space formed between adjacent caissons is preferably of such a shape and size as to form a dry working chamber into which personnel can gain access through an appropriate manhole in the bottom of the upper caisson for the purpose of mechanically connecting the two caissons together by the plurality of dowels, the tensile connections or other means and for effecting, between the two caissons, all the necessary mechanical and electrical connections including those associated with the instrumentation of the platform and with oil drilling apparatus and/or other equipment supported thereon. The dry working chamber also enables personnel to gain access into the lower caisson through an appropriate manhole in the roof of the lower caisson.

Usually, but not necessarily, at least one and preferably each of the separately formed caissons will be subdivided into a plurality of separate compartments or cells, preferably by substantially vertical walls. Preferably, the lower or lowermost caisson has extending downwardly from its undersurface a plurality of downwardly open skirts which, when the platform is sunk on to the sea bed, will penetrate the sea bed.

The upper structure supporting the deck and upstanding from the upper or uppermost caisson may comprise one or more than one column, preferably of circular cross-section. The or each column is preferably provided with a fender or other means which protects the column against impact by a ship or other floating body.

The separately formed caissons and the upper structure of the platform may be made of any convenient material but, for ease of manufacture, preferably each of the caissons and at least the lower part of the upper structure are made of concrete.

Preferably, the base of the platform consists of two separately formed caissons mounted one on top of the other, the roof of the lower caisson having a surface area that is preferably not less than the surface area of the bottom of the upper caisson. By forming the base of the platform of two separetly formed caissons, the functions of the base of a conventional platform can be arranged to be independent of one another. Thus, when a platform consisting of two superposed separately formed caissons is in use, the lower caisson will contain the ballast used for stability during towing of the platform and installation of the platform on the sea bed; the upper caisson can be used for oil storage and/or buoyancy during tow of the floating caisson.

Several advantages arise from forming the base of an offshore gravity platform of the kind described of two separately formed caissons. Of these advantages one of the most important—which is not present where the base of the platform is formed as a monolithic structure—is that the lower caisson and the upper caisson with its upstanding upper structure can be constructed independently at the same or different times and on the same or different construction sites. Since the upper caisson with its upstanding upper structure will usually be substantially larger, and hence take substantially longer to construct than the lower caisson, the upper caisson with its upstanding upper structure can be constructed first and substantially all of the mechanical and electrical equipment and instrumentation, including that associated with the oil drilling or other apparatus to be supported on the platform, installed before construction of the lower caisson is started or completed. This provides for flexibility in design of a platform since the design of the lower caisson can be modified at a late stage to accommodate changes that may arise. Thus, where several platforms might be required for several different sites, the upper caisson and upper structure may be a standard design and the lower caisson of each platform modified for the particular site at which the platform is to be installed. Furthermore, since the draught of each separately formed caisson is substantially less than the overall draught of the platform, construction sites can be employed and towing routes used that would not be suitable had the base of the platform to be constructed been a single monolithic structure.

Accordingly, the invention also includes a method of constructing an offshore gravity platform as hereinbefore described in which the base is formed by constructing a first caisson and constructing a second caisson, at least one of the roof of the first caisson and the bottom of the second caisson being formed with a well in its surface; causing the first caisson to be submerged in the sea and floating it under the floating second caisson; causing the two floating caissons to engage and form a space therebetween; coupling the two caissons together in such a way that the space between them is substantially fluid-tight; and reducing fluid pressure in the space to cause the two caissons to be urged tightly together by hydrostatic pressure.

Where one or each of the caissons is of concrete, preferably the caisson is constructed by casting at least the bottom and a lower portion of the walls of the caisson in a dry dock, floating the partially formed caisson on the sea and casting the upper portion of the caisson on the floating lower portion. Preferably the casting is effected by slipforming.

The invention will be further illustrated by a description, by way of example, of a preferred offshore gravity platform for the drilling for oil or other substance from the bottom of the sea with reference to the accompanying drawings, in which.

Figure 9:
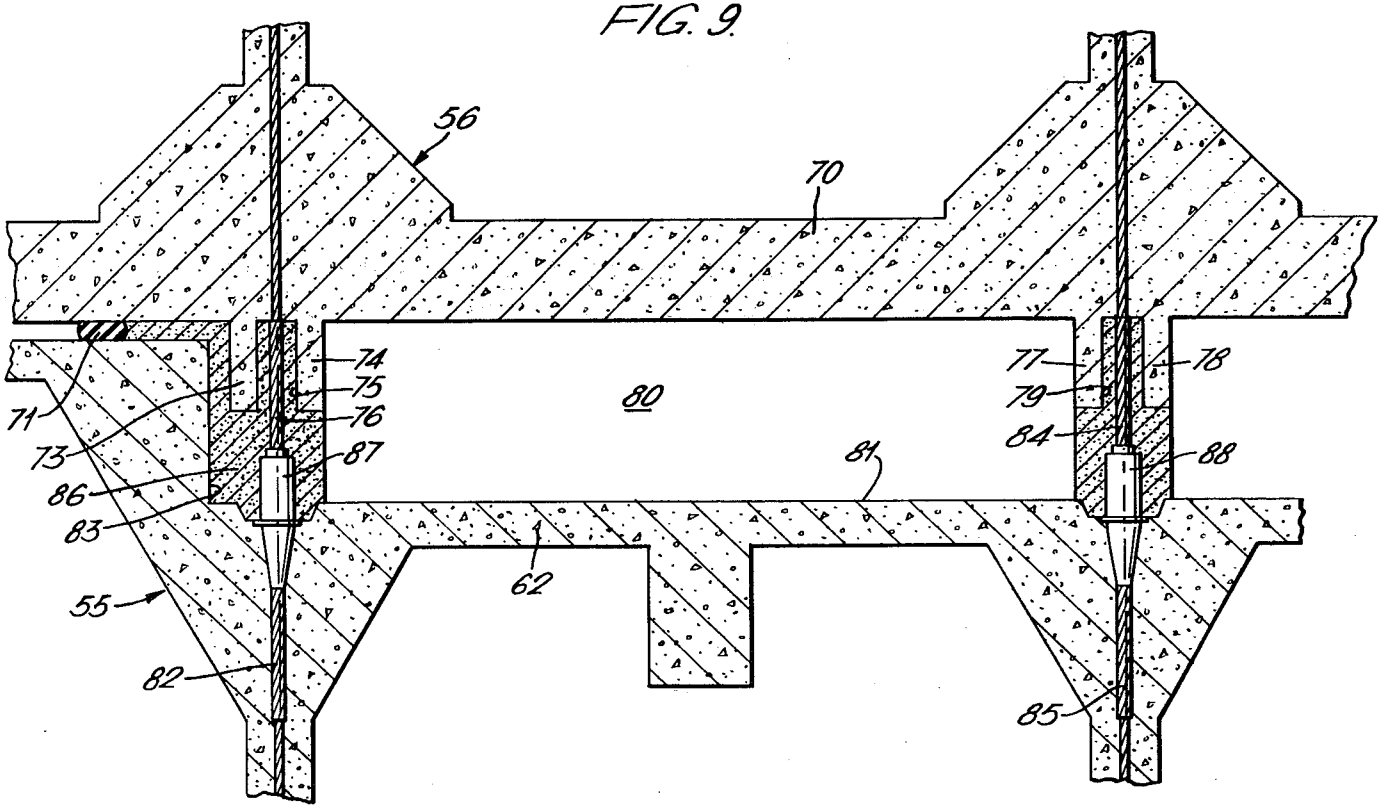

FIG. 7 (a to c) illustrates, diagrammatically, the stages in compression of the preferred form of sealing ring when the two caissons are connected one on top of the other, FIG. 8 (a to h) illustrates, diagrammatically, the stages in the assembly of the platform and positioning of the platform on the sea bed, and FIG. 9 is a fragmental sectional side view illustrating an alternative method of mechanically interconnecting, and effecting a fluid-tight seal between, the separately formed lower and upper caissons constituting the base of a platform.

Referring to FIGS. 1 to 7, the platform comprises a base 1, an upper structure 2 and a deck 3 which supports the equipment, apparatus and accommodation 4 associated with the oil drilling function of the platform. The base 1 is formed of two separately formed concrete caissons 5 and 6, the lower caisson 5 having extending downwardly from its undersurface downwardly open skirts 7 which penetrate the sea bed. As will be explained, the caissons 5 and 6 are mechanically coupled together in such a way that, when the platform is floating on the sea or is standing on the sea bed, movement of one caisson relative to the other is prohibited. The upper structure 2 is a single column 8 of circular cross-section on which the deck 3 is mounted, the column being made of concrete over a major lower part of its length.

The lower caisson 5 is subdivided into eighty-one separate cells of substantially square cross-section by vertical dividing walls 11 and has a roof 12 comprising a prefabricated concrete framework 13 (FIGS. 4 and 5) over which is laid a plurality of prefabricated concrete units 14; a covering layer 15 of concrete is applied overall. In a central portion of the roof 12 of the lower caisson 5 is a well 31 of substantially square shape which, when closed by the bottom 20 of the upper caisson 6, constitutes a square space (FIG. 2) 30 forming a working chamber between the two caissons. The upper caisson 6 is similarly subdivided into forty-nine cells by vertical dividing walls 21 and has a roof 22 of similar construction to that of the lower caisson 5.

The methods of mechanically interconnecting, and effecting a fluid tight seal of the square space 30 between, the two caissons 5 and 6 are shown in FIGS. 4 to 7. In the concrete layer 15 of the roof 12 and surrounding the square well 31 is a continuous groove 32 (see also FIG. 2) of substantially rectangular cross-sectional shape in which engages a square skirt 23 which extends downwardly from the undersurface of the bottom 20 of the upper caisson 6. At each of a plurality of spaced positions along each wall 33 of the square well 31 is a blind hole 34 of circular cross-section whose axis lies in a substantially horizontal plane, which intersects the square groove 32 and which is lined with steel rings 35 and 36. The downwardly extending square skirt 23 of the upper caisson 6 also has, at each of a plurality of spaced positions around the skirt, a hole 24 of circular cross-section which is of a similar size to and is aligned with a blind hole 34 and which is lined with a steel ring 25. Engaging in each pair of aligned holes 24, 34 is a dowel comprising a steel tube 27 filled with concrete 28.

Positioned between the roof 12 of the lower caisson 5 and the bottom 20 of the upper caisson 6, inwardly and outwardly of the groove 32 surrounding the well 31 are two rubber sealing rings 41 and 42 which provide fluid tight seals for the space 30. The parts of the groove 32 not occupied by the skirt 23 and the parts of the holes 24 and 34 not occupied by the concrete filled steel tube 27 are filled with grout 38.

Near the peripheral edge of the upper caisson 6 the undersurface of the bottom 20 is shaped to form an endless step 29 and the neighbouring part of the concrete layer 15 of the roof 12 of the lower caisson 5 is shaped to form an endless flat-topped shoulder 19. A rubber sealing ring 43 is positioned between the shoulder 19 and the step 29. The space between the roof 12 of the lower caisson 5 and the bottom 20 of the upper caisson 6 bounded by the sealing rings 42 and 43 is filled with grout 45.

Figure 1:
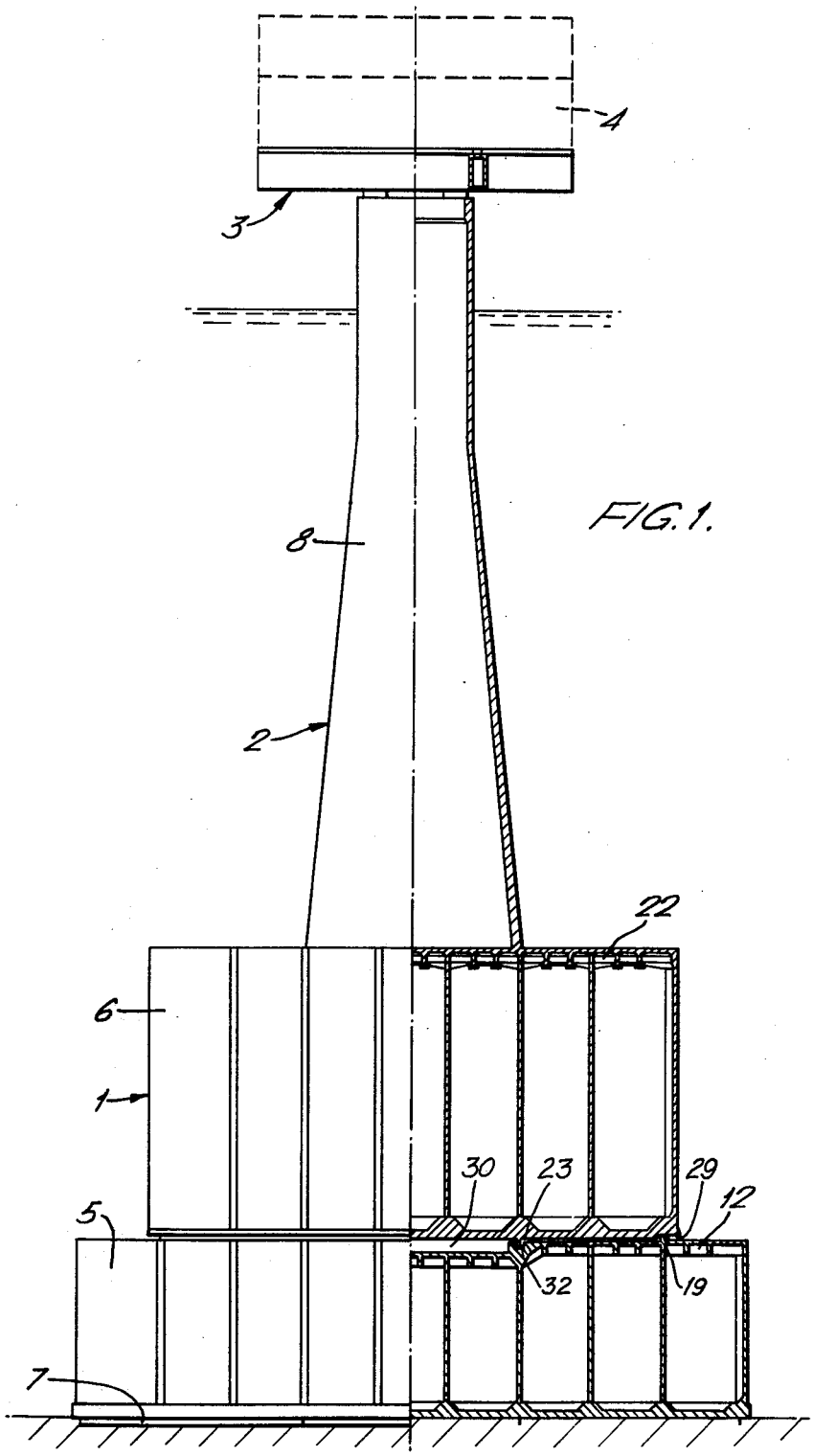
FIG. 1 is a side view, partly in section and partly in elevation, of the platform standing on the sea bed.
Figure 2:
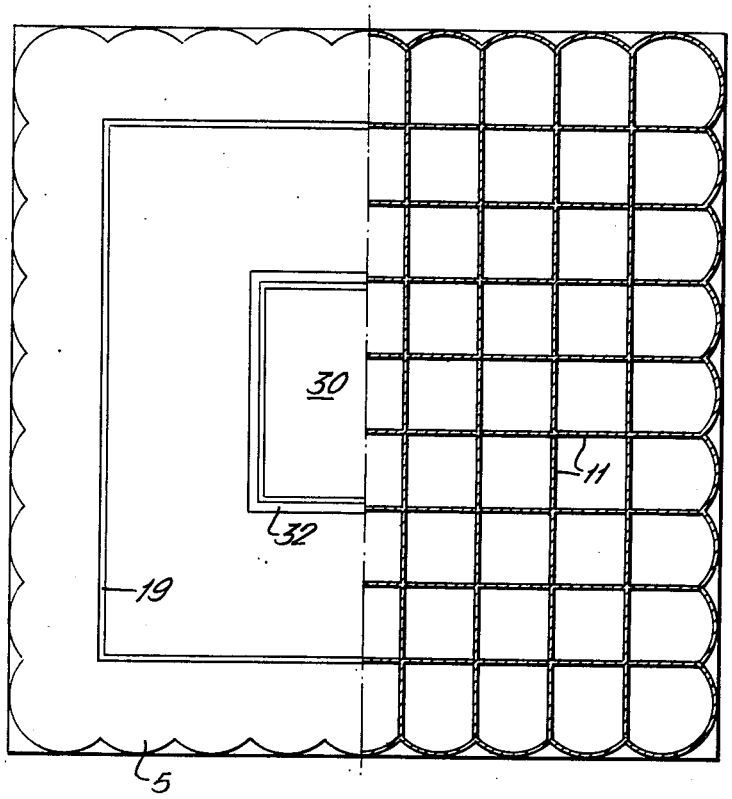
FIG. 2 is a view from above, partly in section, of the lower caisson of the base of the platform.
Figure 3:
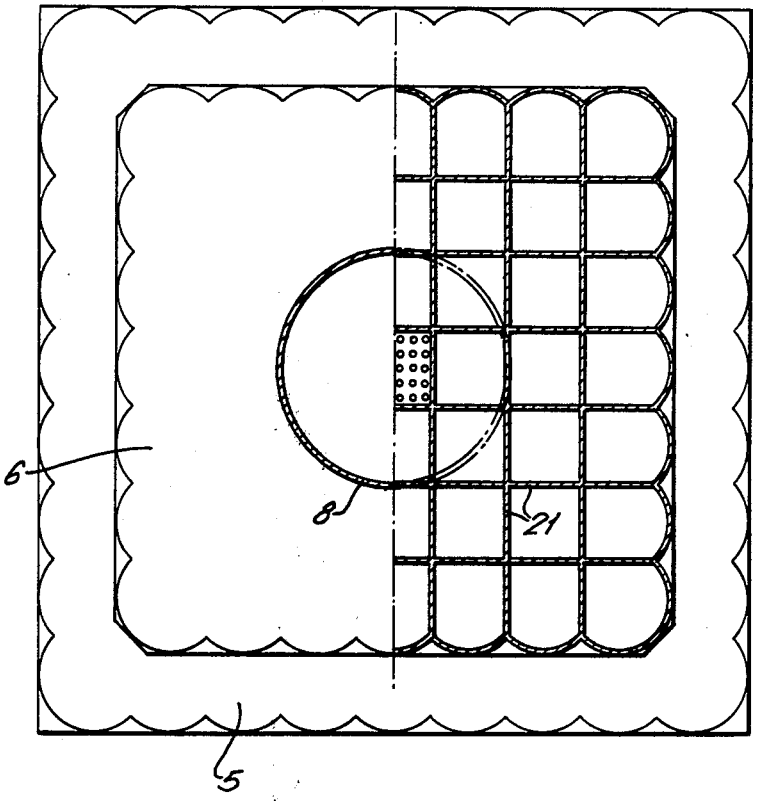
FIG. 3 is a view from above, partly in section, of the upper caisson of the base of the platform.
Figure 4:
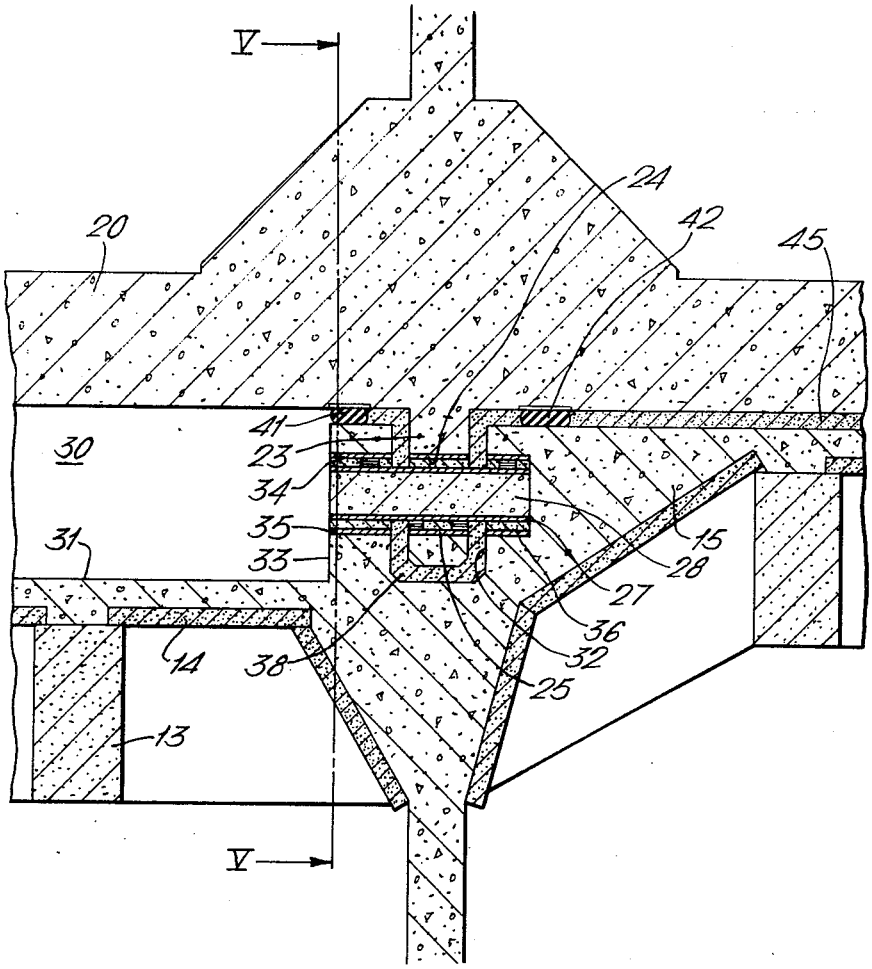
FIG. 4 is a fragmental sectional side view illustrating one preferred method of mechanically interconnecting, and effecting a fluid-tight seal between, the separately formed lower and upper caissons constituting the base of the platform.
Figure 5:
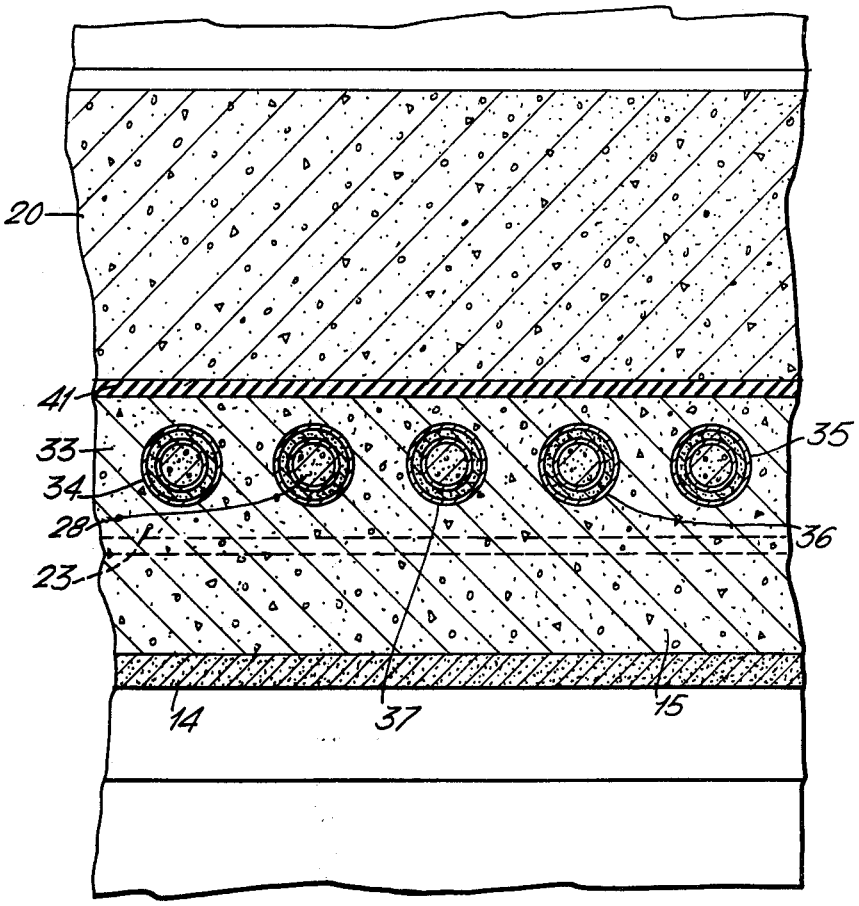
FIG. 5 is a fragmental sectional view taken on the line V—V in FIG. 4.
Figure 6:
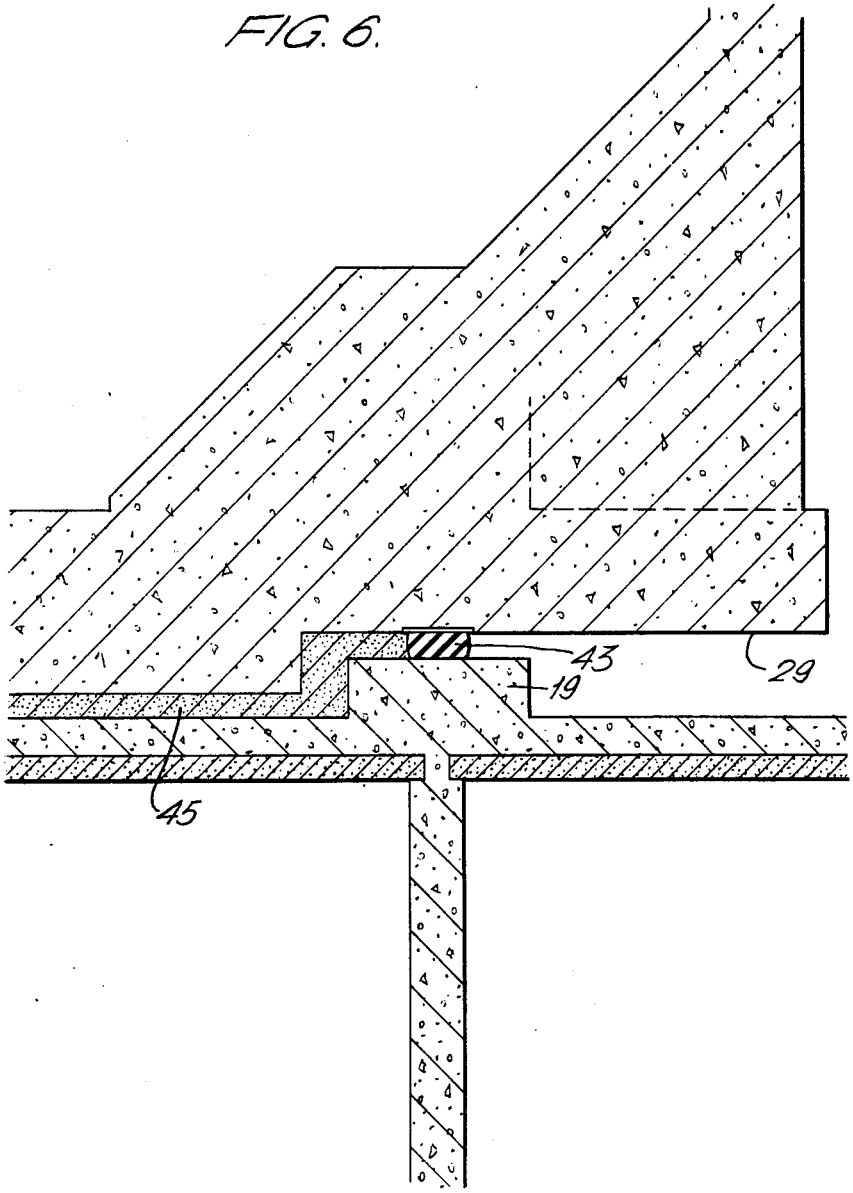
FIG. 6 is a fragmental sectional side view illustrating the preferred method of effecting a fluid-tight seal between the two caissons near the side faces of the upper caisson.
Figure 7A:
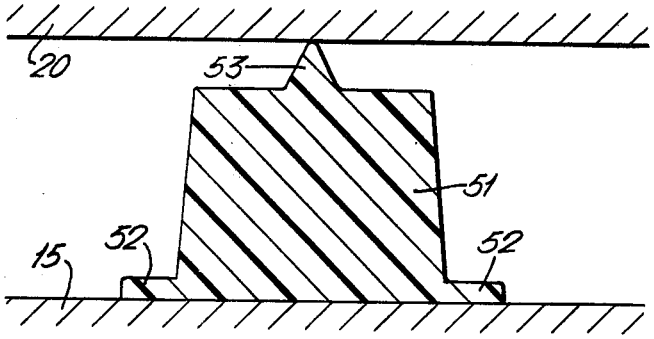
Figure 7B:
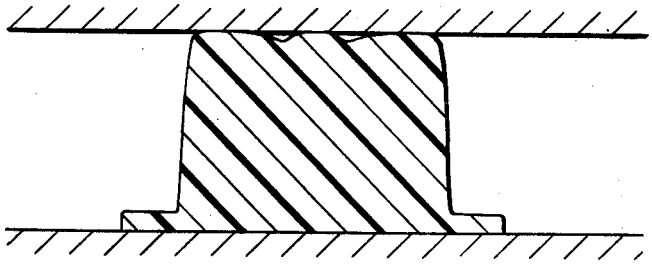
Figure 7C:
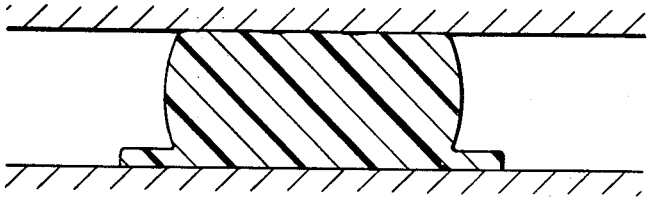

Each of the sealing rings 41, 42 and 43 has a Vredestein-Gina profile as shown in FIG. 7*a* and comprises a main body portion 51 of a rubber 50°–55° shore, which has a transverse cross-section in the shape of a rhombus and bottom flanges 52, and upstanding from the top of the body portion 51, a rib 53 of a rubber 35° shore which has a transverse cross-section in the shape of a triangle. When the lower caisson 5 and upper caisson 6 are brought together, each of the sealing rings 41, 42 and 43 is initially compressed as shown in FIG. 7*b* and is completely compressed to the shape shown in FIG. 7*c*, thereby forming a substantially fluid-tight seal between the two caissons.

In constructing the platform shown in FIGS. 1 to 7 the bottom and lower parts of the outer and dividing walls of the upper caisson 6 are cast in a dry dock and the lower part of the upper caisson is then floated to a floating construction site for casting by slip forming the upper ends of the outer and dividing walls and the column 8 and for casting the roof 22. While the upper caisson 6 and column 8 are being completed at the floating construction site, the lower caisson 5, including the skirts 7, is cast either wholly in dry dock or, if the depth of the dry dock is such that this is not possible, partly in a dry dock, the upper parts of the caisson 5 then being completed at a floating construction site.

As will be seen on referring to FIGS. 8*a* to *h*, when it is required to assemble the platform and position it on the sea bed, the lower caisson, with the sealing rings 41, 42 and 43 secured in place on the upper surface of its roof 12, is towed to a site with sufficient depth of water and then allowed to sink below the surface of the sea supported by buoyancy vessels B (FIG. 8*a*). The submerged lower caisson 5 is now floated below the upper caisson 6 supporting the column 8 (FIG. 8*b*) and the caisson 5 is then raised by pumping out the sea water at least until the skirt 23 of the upper caisson engages in the groove 32 in the roof 12 of the lower caisson (FIG. 8*c*). Water is now withdrawn from the space 30 formed between the roof 12 of the caisson 5 and the bottom 20 of the upper caisson 6 so that the caissons are urged together by hydrostatic pressure and the space is sealed by the rings 41, 42 and 43 to form a dry working chamber. Personnel can now enter the working chamber 30 through an appropriate manhole in the bottom 20 of the upper caisson and insert the concrete filled steel dowels 27 into the aligned holes 24, 34 to provide for transmission of forces between the two caissons. The necessary mechanical and electrical connections, including those associated with the oil drilling apparatus and with the instrumentation of the platform are also effected. Water is now introduced into the lower caisson 5 so that the pressures of the water inside and outside the lower caisson are maintained substantially equal and the immersion towers T, buoyancy vessels B and other positioning gear are removed (FIG. 8*d*). Ballast, for example water, is then introduced into the upper caisson 6 until the column 8 is submerged to a sufficient extent to allow the deck 3 to be floated above and to be secured to the column (FIG. 7*e*). The upper caisson 6 is then de-ballasted to raise the structure to a level suitable for towing to the final site (FIG. 8*f*). Sinking of the platform on to the sea bed to cause the skirts 7 to penetrate the sea bed is then effected in the conventional manner by ballasting the upper caisson 6, preferably with water (FIG. 8*h*).

FIG. 9 illustrates an alternative method of mechanically interconnecting, and effecting a fluid-tight seal between, a separately formed lower caisson 55 and an upper caisson 56 constituting the base of a platform. The lower caisson 55 has a roof 62 in a central part of which is a well 81 of substantially square shape which, when closed by the bottom 70 of the upper caisson 56, constitutes a space 80 forming a working chamber between the two caissons. Extending downwardly from the bottom 70 of the upper caisson 56 are two continuous walls 73 and 74, each defining a square, which bound a square channel 75 and which, when the two caissons are mounted one on top of the other, protrude into the well 81 adjacent to but spaced from the wall 83 of the well. At each of a plurality of space positions around the square channel 75 protrudes a stressing cable 76. At each of a plurality of spaced positions around the periphery of the well 81 is a stressing cable 82 which is in alignment with a stressing cable 76. Each pair of aligned stressing cables 76, 82 is mechanically connected together by a coupling 87, the stressing cables being coupled together by personnel in the working chamber formed by the space 80. Positioned between the roof 62 of the lower caisson 55 and the bottom 70 of the upper caisson 56 outwardly of the well 81 is a rubber sealing ring 71 which is of similar form to the sealing ring illustrated in FIG. 7 (*a* to *c*) and which provides a fluid-tight seal for the space 80. The parts of the well 81 between the lowermost end of the continuous walls 73 and 74 and the base of the well, the parts of the channel 75 not occupied by stressing cables 76 and the parts of the well between the continuous wall 73 and the sealing ring 71 are filled with grout 86. The bottom 70 of the upper caisson 56 also has, inwardly of the continuous walls 73, 74 other downwardly extending walls 77, 78 bounding a channel 79 (one pair only of which is shown) which extends partway across the width of the square well 81. Stressing cables 84 protrude from the channel 79 and are mechanically coupled by couplings 88 to appropriately aligned stressing cables 85 protruding from the roof 62 of the lower caisson 55.

Although, in the foregoing example, the platform has been described as for use for the drilling for oil from the bottom of the sea, it has to be understood that the offshore gravity platform of the present invention is not restricted to this use; other uses for which the platform may be employed include the production and/or storage of oil and gas, industrial/chemical plant complexes, offshore lighthouses, offshore forts and helicopter ports.

It will be appreciated that since, in service, the water pressure inside and outside of the lower caisson is substantially the same, the outer wall of the lower caisson is not required to resist the water pressure it would otherwise have to withstand when submerged on the sea bed with a result that the walls can be thinner than the walls of monolithic bases of known platforms with a consequential saving in material and construction time. Furthermore, since the upper caisson is not required to contain heavy ballast and is not required to withstand extreme stress caused by uneven sea bed conditions during installation, the bottom of the upper caisson need not be as substantial as monolithic bases of known platforms, again with a consequential saving in material and construction time.

The offshore gravity platform of the present invention is especially, but not exclusively, suitable for use at sites in areas where the bed of the sea may be subjected to movement caused by an earthquake or other natural phenomena because the stiffness characteristics of the base of the platform can be adjusted to accommodate for any such movement of the sea bed.

What I claim as my invention is:

1. An offshore gravity platform comprising a hollow base and, upstanding from the base, an upper structure slimmer than the base, which platform can form a floating body for movement from one place to another and which, when required, can be sunk to stand on the sea bed with the upper structure protruding above the surface of the sea, wherein the base consists of at least two separately formed caissons which are mounted one on top of the other or another, the roof of the lower of adjacent caissons and the bottom of the adjacent upper caisson being so shaped as to form between the caissons a space which is rendered substantially fluid-tight and wherein, when the platform is floating on the sea and when the platform is standing on the sea bed, fluid pressure in the space between the caissons is such that adjacent caissons are urged tightly together by hydrostatic pressure.

2. An offshore gravity platform as claimed in claim 1, wherein the space formed between said adjacent caissons is sealed by at least one sealing ring of elastomeric material positioned between the two caissons.

3. An offshore gravity platform as claimed in claim 1, wherein the space formed between said adjacent caissons is of such a shape and size as to form a working chamber into which personnel can gain access through a manhole in the bottom of the upper of said adjacent caissons.

4. An offshore gravity platform as claimed in claim 1, wherein the base of the platform consists of two separately formed caissons mounted one on top of the other, the roof of the lower caisson having a surface area that is at least equal to the surface area of the bottom of the upper caisson.

5. An offshore gravity platform as claimed in claim 1, wherein each of the separately formed caissons is subdivided by substantially vertical walls into a plurality of separate cells.

6. An offshore gravity platform as claimed in claim 1, wherein the lowermost caisson has extending downwardly from its undersurface a plurality of downwardly open skirts which, when the platform is sunk on to the sea bed, will penetrate the sea bed.

7. An offshore gravity platform as claimed in claim 1, wherein each of the caissons and at least the lower part of the upper structure are made of concrete.

8. An offshore gravity platform as claimed in claim 1, wherein the upper structure supporting the deck and upstanding from the uppermost caisson comprises at least one column.

9. An offshore gravity platform as claimed in claim 8, wherein the or each column has means for protecting the column against impact by a ship.

10. An offshore gravity platform as claimed in claim 1, wherein the base consists of two separately formed caissons mounted one on top of the other, the roof of the lower caisson having a substantially greater cross-sectional area than the bottom wall of the upper caisson.

11. An offshore gravity platform as claimed in claim 10, wherein the height of the upper caisson is substantially greater than that of the lower caisson.

12. An offshore gravity platform as claimed in claim 1, wherein the water pressure inside and outside of the lower or lowermost caisson is substantially the same.

13. An offshore gravity platform comprising a hollow base and, upstanding from the base, an upper structure slimmer than the base, which platform can form a floating body for movement from one place to another and which, when required, can be sunk to stand on the sea bed with the upper structure protruding above the surface of the sea, wherein the base consists of at least two separately formed caissons which are mounted one on top of the other or another, the roof of the lower of adjacent caissons and the bottom of the adjacent upper caisson being so shaped as to form between the caissons a space which is rendered substantially fluid-tight; and wherein, when the platform is floating on the sea and when the platform is standing on the sea bed, fluid pressure in the space between the caissons is such that adjacent caissons are urged tightly together by hydrostatic pressure and adjacent caissons are so mechanically secured together that movement of one caisson relative to the other of said adjacent caissons is substantially prohibited.

14. An offshore gravity platform as claimed in claim 13, wherein at least one of the roof of the lower of said adjacent caissons and the bottom of the adjacent upper caisson has in its surface a groove which surrounds the space formed between the two caissons, and the other of said adjacent caissons has a skirt extending therefrom which engages in the groove and is secured therein.

15. An offshore gravity platform as claimed in claim 13, wherein adjacent caissons are mechanically secured together by stressing members protruding from the bottom of the upper of said adjacent caissons and from the roof of the lower caisson, which stressing members are coupled together and so stressed that the two caissons are mechanically secured together under tension.

16. An offshore gravity platform comprising a hollow base and, upstanding from the base, an upper structure slimmer than the base, which platform can form a floating body for movement from one place to another and which, when required, can be sunk to stand on the sea bed with the upper structure protruding above the surface of the sea, wherein the base consists of at least two separately formed caissons which are mounted one on top of the other or another, at least one of the roof of the lower of adjacent caissons and the bottom of the adjacent upper caisson being so shaped as to form between the caissons a space which is rendered substantially fluid-tight; and wherein when the platform is floating on the sea and when the platform is standing on the sea bed fluid pressure is such that adjacent caissons are urged tightly together by hydrostatic pressure; and said adjacent caissons are so mechanically secured together that movement of one caisson relative to the other of said adjacent caissons is substantially prohibited, at least one of the roof of the lower of said adjacent caissons and the bottom of the adjacent upper caisson having in its surface a groove which surrounds the space formed between the two caissons, and the bottom of the other of said adjacent caissons has a skirt extending therefrom which engages in the groove and is secured therein, and wherein the skirt is secured in the groove by means of a plurality of dowels, each dowel engaging in aligned holes in the part of that caisson surrounding the space between the two caissons and in the skirt.

17. An offshore gravity platform comprising a hollow base and, upstanding from the base, an upper structure slimmer than the base, which platform can form a floating body for movement from one place to another and which, when required, can be sunk to stand on the sea bed with the upper structure protruding above the surface of the sea, wherein the base consists of at least two separately formed caissons which are mounted one on top of the other or another, at least one of the roof of the lower of adjacent caissons and the bottom of the adjacent upper caisson being so shaped as to form between the caissons a space which is rendered substantially fluid-tight; and wherin when the platform is floating on the sea and when the platform is standing on the sea bed, fluid pressure is such that adjacent caissons are urged tightly together by hydrostatic pressure; and said adjacent caissons are so mechanically secured together that movement of one caisson relative to the other of said adjacent caissons is substantially prohibited, said adjacent caissons being mechanically secured together by stressing members protruding from the bottom of the upper of said adjacent caissons and from the roof of the lower caisson, which stressing members are coupled together and so stressed that the two caissons are mechanically secured together under tension, and wherein two continuous walls bounding a continuous channel extend downwardly from the bottom of the upper of said adjacent caissons into the space formed between the two caissons and are spaced from the boundary wall of said space and stressing members protrude from the bottom of said upper caisson at spaced positions around the continuous channel.

18. A method of constructing an offshore gravity platform comprising a hollow base and, upstanding from the base, an upper structure slimmer than the base, which platform can form a floating body for movement from one place to another and which, when required, can be sunk to stand on the sea bed with the upper structure protruding above the surface of thd sea, in which method the base of the platform is formed by constructing a first caisson and constructing a second caisson, the roof of the first caisson and the bottom of the second caisson being so shaped that when arranged one above and in contact with the other a space is formed between the two caissons causing the first caisson to be submerged in the sea and floating it under the floating second caisson; causing the two floating caissons to engage and form a space therebetween; coupling the two caissons together in such a way that the space between them is substantially fluid-tight; and reducing fluid pressure in the space to cause the two caissons to be urged tightly together by hydrostatic pressure.

19. A method as claimed in claim 18, wherein the two caissons are mechanically secured together.

20. A method as claimed in claim 18, wherein at least one of the caissons is of concrete and is constructed by casting at least the bottom and lower portions of the walls of the caisson in dry dock, floating the partially formed caisson in the sea and casting the upper portion of the caisson on the floating lower portion.

21. A method as claimed in claim 20, wherein at least a substantial proportion of the casting is effected by slip forming.

* * * * *

UNITED STATES PATENT AND TRADEMARK OFFICE

CERTIFICATE OF CORRECTION

PATENT NO. : 4,155,671
DATED : May 22, 1979
INVENTOR(S) : Charles J. Vos

It is certified that error appears in the above-identified patent and that said Letters Patent are hereby corrected as shown below:

Column 5, line 65, "(FIG. 7e)" should read --(FIG. 8e)--.

Claim 17, column 9, line 11, "wherin" should read --wherein--.

Signed and Sealed this

*Eleventh* Day of *September 1979*

[SEAL]

*Attest:*

LUTRELLE F. PARKER

*Attesting Officer* *Acting Commissioner of Patents and Trademarks*